US005529600A

United States Patent [19]

Fernandez et al.

[11] Patent Number: 5,529,600

[45] Date of Patent: Jun. 25, 1996

[54] MATERIAL FOR FRICTION COMPONENTS DESIGNED TO OPERATE IN A LUBRICATED ENVIRONMENT AND A PROCEDURE FOR OBTAINING IT

[75] Inventors: Antonio R. Fernandez, Vilassar De Mar, Spain; Pascal Belair, Orches; Jean R. Gras, Bouffemont, both of France

[73] Assignee: Sintermetal S.A., Ripollet, Spain

[21] Appl. No.: 256,724

[22] PCT Filed: Dec. 3, 1993

[86] PCT No.: PCT/ES93/00097

§ 371 Date: Jul. 22, 1994

§ 102(e) Date: Jul. 22, 1994

[87] PCT Pub. No.: WO94/13846

PCT Pub. Date: Jun. 23, 1994

[30] Foreign Application Priority Data

Dec. 7, 1992 [FR] France ..... 92 14700

[51] Int. Cl.[6] ..... B22F 5/08

[52] U.S. Cl. ..... 75/228; 75/229; 75/230; 75/246; 428/548; 428/567; 428/569; 149/30; 149/32; 149/48

[58] Field of Search ..... 428/548, 567–569; 75/228, 229, 230, 246; 419/30, 31, 48; 420/111, 118, 124

[56] References Cited

U.S. PATENT DOCUMENTS

| | | | |
|---|---|---|---|
| 4,233,073 | 11/1980 | Takemura | 75/243 |
| 4,552,590 | 11/1985 | Nakata et al. | 75/246 |
| 5,080,713 | 1/1992 | Ishibashi et al. | 75/246 |

*Primary Examiner*—Peter A. Nelson
*Assistant Examiner*—John N. Greaves
*Attorney, Agent, or Firm*—Michael J. Striker

[57] ABSTRACT

A material for friction components made by a process including the steps of providing a first powder consisting of grains of a comparatively harder material with a comparatively higher coefficient of friction and an average grain size of from 60 to 100 microns, and a second powder consisting of grains of comparatively softer material with a comparatively lower coefficient of friction and an average grain size of from 60 to 100 microns; mixing the first powder and the second powder to form a powder mixture having a total volume; and subjecting the powder mixture to a pressure and temperature sufficient for the grains of the first powder to be intermixed with the comparatively softer material of the second powder so that the comparatively harder material substantially fills an intergranular space between the grains of the first powder to form the material for the friction components, the comparatively harder material occupying from ⅓ to ⅘ of the total volume of the powder mixture.

13 Claims, No Drawings

MATERIAL FOR FRICTION COMPONENTS DESIGNED TO OPERATE IN A LUBRICATED ENVIRONMENT AND A PROCEDURE FOR OBTAINING IT

The present invention relates to a material for friction components which operate in lubricated tribological systems, and in particular, but not exclusively, to the manufacture of synchronization rings for use in manual gearboxes.

BACKGROUND OF THE INVENTION

The development of materials for gearboxes is subject to many demands, some of them mutually contradictory. On the one hand, the gears must be effectively lubricated, i.e. the coefficient of friction between them must be as low as possible, while on the other hand, the synchronizing rings must have a high coefficient of friction which remains constant independently, in particular, of the temperature, the speed and the pressure.

One suggestion is to cover the active surface of the synchronizing rings with a suitable material such as molybdenum. This method is expensive.

Another technique is aimed at preventing an oil layer from forming, or causing the oil film to break by creating geometric irregularities by machining grooves or the like or by means of finer heterogeneities by using a non-homogeneous material, in particular a relatively soft matrix containing harder particles. Nevertheless, these friction materials have until now given results which vary according to the conditions under which they are used.

The studies carried out have lead to the conclusion that these materials could provide good results, at a relatively low cost, if certain conditions are fulfilled.

SUMMARY OF THE INVENTION

The aim of the present invention is therefore to provide a friction material that enables a high coefficient of friction to be achieved, with little dependence on the conditions of use, and with which it is possible to obtain components in a suitable way at a low cost.

To achieve this, the invention provides a material designed for making friction components in lubricated media, this material having the particular characteristic that it comprises different regions, between 60 and 500, advantageously from 60 to 100, microns in size, and at least two substances with different hardnesses and different coefficients of friction, the harder substance being the one with the higher coefficient of friction and the one which occupies a volume between ⅓ and ⅘ of the total volume.

The remaining volume of the material is occupied by the softer substance and by the porosity resulting from the method of manufacture.

It has been shown that if the proportion of the harder substance is less than ⅓ of the total volume the desired result is not achieved. If the proportion of the harder substance is increased in the manufacture of the material, a sintered compression technique becomes the only practical possibility and it is very difficult or very expensive to prevent the formation of a considerable amount of porosity. In practice it is therefore very difficult to exceed the limit of ⅘ of the total volume for the regions of the harder substance. Advantageously, the material according to the invention has the form of grains of hard material joined together by a matrix which fills most of the intergranular space, the rest of this space constituting porosity.

It is clear that the wear of the material of the invention causes a micro-relief to appear on its surface and that according to the dimensions specified for the respective regions, this micro-relief is sufficient to cause the oil film to break, thereby leading to a high coefficient of friction.

The hard material is chosen from among those which retain their surface hardness, have a high coefficient of friction and have a surface which is "passivated" by reaction in the tribological system mentioned above.

A passivatable surface is taken to mean a surface on which a continuous, impermeable oxide layer is formed in the medium in question. This layer constitutes a barrier between the material and its environment.

When the material is to be used in the presence of a lubricant containing an additive, the hard material is chosen preferably from those materials which retain their coefficient of friction in the presence of the lubricant containing the additive. More particularly, if the additive is a organo-sulfur compounds and borate ester compounds, the hard material chosen is a steel containing one or more passivatable carbide-generating elements such as Cr, Mo, V, W, Si.

Advantageously, the harder material is a steel in which the sum of the elements Cr, Mo, V, W and Si is at least 12% and the softer material is a steel in which the sum of the elements Cr, Mo, V, W and Si is less than 8%.

The separation between the regions of carbide-forming elements gives rise to a difference in hardness which leads to formation of the micro-relief mentioned above. Production difficulties mean that the maximum amount of elements for the harder material is 30%. On the other hand, there is no reason why the softer material should not contain any of these elements.

According to one particularly interesting embodiment, the hard material is a steel with the following composition: Cr: 4%, Mo: 5%, V: 3%, W: 6%, Si: 2%, C: 0.6%, and the rest Fe and impurities. This steel attains hardnesses of greater than 700 HV 0.1.

Preferably, the softer material is a low alloy steel and, according to one particularly interesting embodiment, the softer material has the following composition: Ni: 1.5%, Cu: 2%, Mo: 0.5%, C: 0.6%, and the rest Fe and impurities. This hardness of this steel is between 200 and 500 HV 0.1.

The invention further provides a procedure for obtaining a material such as the one which has been described.

According to this procedure, a first powder, with the composition of the first hard material, is mixed with a second powder, with the composition of the softer material, and the mixture is subjected a pressure and temperature which is sufficient for the grains of the first powder to be joined together by the material of the second powder, and that this fills the most of the inter-granular spaces.

The best results are obtained when the weights of the two powders are approximately the same.

EXAMPLES

The following tables show the results of eight tests which enable the results obtained using test pieces according to the invention to be compared with those obtained with several standard test pieces. The tests were carried out in a tribometer with cylindrical test pieces, 3 mm in diameter, whose characteristics are described in table 1. The bolt/disc type tribometer is designed to ensure the lubrication of the contact and to vary the temperature, the contact pressure and the speed of rotation of the disc.

The coefficients of friction shown in columns 5 and 6 of table 2 were determined from the frictional forces measured in the tribometer. Table 2 shows the results for the following speeds:

- 0.34 m/s which, according to the current art, corresponds to the limit lubrication (coefficient of friction greater than 0.1) or mixed (coefficient of friction between 0.1 and 0.03) lubrication conditions, and
- 1.7 m/s which, according to the usual art, corresponds to hydrodynamic lubrication conditions (coefficient of friction less than 0.03).

Tests 1 and 2 were carried out with test pieces machined from bars of brass rich in silicon. This composition is normally used to manufacture the synchronizing rings used in manual gearboxes.

Tests 1A and 1B were carried out with the same type of test piece but in test 1B the temperature was relatively high: 80° C. while in the other tests it was lower: 10° or 20° C.

In test 2 the test pieces were machined with grooves 0.5 mm in height, with a ridge width and groove base of 0.2 mm.

The test pieces used in test 3 were obtained by hot spattering of a layer of molybdenum onto a brass substrate.

The test pieces used in test 4 correspond to the invention. They were manufactured by compressing an equal mixture of the powders described above.

The test pieces used in test 5 were made as the test pieces of test 4, but without adding the powder which has the composition of the hard material.

The test pieces used for test 6 were similar to those of test 4 but the powder of the hard material was less alloyed.

The test pieces of test 7 were manufactured in the same way as those of test 4, but the proportion powder of the hard material was reduced to 25% by weight.

It is conceivable within the scope of the invention to manufacture test pieces made entirely from the powder with the composition of the hard material, but this was not taken into consideration due to the high cost of the raw material as well as the practical difficulties implied (pressing and sintering).

RESULTS

The analysis of the results set out in table II shows that:

The brass exhibits mixed lubrication conditions at low speeds and hydrodynamic lubrication conditions at high speeds. When the temperature increases, i.e. with a lower oil viscosity, only the limit lubrication conditions are exhibited. Test 2 shows the effect of grooving the brass. This leads to limit lubrication conditions at 20° C. regardless of the speed. This behavior is characteristic of brass-based friction materials according to the state of the art.

Test 3 confirms that the molybdenum hot projection always exhibits limit conditions, even at low temperatures (10° C).

The samples of test 4 which correspond to the invention exhibit only one limit lubrication condition and have a higher coefficient of friction than the molybdenum.

Test 5 shows that in the absence of heterogeneities only hydrodynamic lubrication conditions are exhibited.

Test 6 shows that the desired effect is not obtained if the powder with the composition of the hard material has an insufficient percentage of passivatable carbide generating alloy elements.

Finally, the results of test 7 show that when the proportion of the powder alloy elements is reduced, the effect disappears, i.e. the coefficient of friction decreases considerably when the slipping speeds are high.

TABLE I

| Test piece | Type | Composition |
|---|---|---|
| 1 | Brass, state of the art | 0.75% Si, 1.75% Al, 3% Mn, rest Cu |
| 2 | Brass, state of the art | 0.75% Si, 1.75% Al, 3% Mn, rest Cu, grooved |
| 3 | Molybdenum, state of the art | 100% Mo |
| 4 | invention | 50% powder with 1.5% Ni, 2% Cu, 0.5% Mo, 0.6% C<br>50% powder with 4% Cr, 5% Mo, 3% V, 6% W, 2% Si, 0.6% C |
| 5 | reference | 100% powder with 1.5% Ni, 2% Cu, 0.5% Mo, 0.6% C |
| 6 | reference | 50% powder with 1.5% Ni, 2% Cu, 0.5% Mo, 0.6% C<br>50% powder with 5% Cr, 1% Mo, 1% Si, 0.6% C |
| 7 | reference | 75% powder with 1.5% Ni, 2% Cu, 0.5% Mo, 0.6% C<br>25% powder with 4% Cr, 5% Mo, 3% V, 6% W, 2% Si, 0.6% C |

TABLE II

| Test | Test piece | Temp. °C. | Pressure MPa | Speed 0.34 m/s | 1.7 m/s |
|---|---|---|---|---|---|
| 1A | 1 | 20 | 80 | 0.080 | 0.015 |
| 1B | 1 | 80 | 90 | 0.125 | 0.115 |
| 2 | 2 | 20 | 80 | 0.125 | 0.115 |
| 3 | 3 | 10 | 80 | 0.115 | 0.100 |
| 4 | 4 | 20 | 56 | 0.115 | 0.100 |
| 5 | 5 | 20 | 56 | 0.090 | 0.025 |
| 6 | 6 | 20 | 56 | 0.095 | 0.025 |
| 7 | 7 | 20 | 56 | 0.100 | 0.030 |

We claim:

1. A material for friction components made by a process comprising the steps of:

a) providing a first powder consisting of grains of a comparatively harder material with a comparatively higher coefficient of friction, said grains of said first powder having an average grain size of from 60 to 100 microns, and a second powder consisting of grains of comparatively softer material with a comparatively lower coefficient of friction, said grains of said second powder having an average grain size of from 60 to 100 microns;

b) mixing said first powder and said second powder to form a powder mixture having a total volume; and c) subjecting said powder mixture to a pressure and temperature sufficient for said grains of said first powder to be intermixed with said comparatively softer material of said second powder so that said comparatively softer material substantially fills an intergranular space between said grains of said first powder to form the material for the friction components, said comparatively harder material occupies from ⅓ to ⅘ of the total volume of the powder mixture.

2. The material for friction components as defined in claim 1, wherein said comparatively harder material occupies approximately half of the total volume.

3. The material for friction components as defined in claim 1, wherein said comparatively harder material maintains said comparatively higher coefficient of friction in a presence of a lubricant containing an additive.

4. The material for friction components as defined in claim 3, wherein said comparatively harder material is a steel containing at least one element selected from the group consisting of Cr, Mo, V, W and Si and said additive contains a member selected from the group consisting of organosulfur compounds and borate ester compounds.

5. The material for friction components as defined in claim 1, having a porosity.

6. The material for friction components as defined in claim 1, wherein said comparatively harder material is a steel containing at least one element selected from the group consisting of Cr, Mo, V, W and Si and a total amount of said at least one element present is at least 12% and said comparatively softer material is another steel having a total content of said Cr, Mo, V, W and Si of less than 8 %.

7. The material for friction components as defined in claim 6, wherein said steel of said comparatively harder material consists essentially of 4% of said Cr, 5% of said Mo, 3% of said V, 6% of said W, 2% of said Si, 0.6% of C and with a balance of iron.

8. The material for friction components as defined in claim 1, wherein said comparatively softer material is a low alloy steel.

9. The material for friction components as defined in claim 1, wherein said comparatively softer material consists essentially of 1.5% Ni, 2% Cu, 0.5% Mo, 0.6% C and with a remaining portion of the comparatively softer material consisting of iron.

10. A method of making a material for friction components, said method comprising the steps of:

a) providing a first powder consisting of grains of a comparatively higher hardness material with a comparatively higher coefficient of friction, said grains of said first powder having average grain size of from 60 to 100 microns, and a second powder consisting of grains of comparatively lower hardness material with a comparatively lower coefficient of friction, said grains of said second powder having an average grain size of from 60 to 100 microns;

b) mixing said first powder and said second powder to form a powder mixture having a total volume; and c) subjecting said powder mixture to a pressure and temperature sufficient for said grains of said first powder to be intermixed with said comparatively lower hardness material of said second powder so that said comparatively lower hardness material substantially fills an intergranular space between said grains of said first powder and the material for the friction components is formed, said comparatively higher hardness material occupies from ⅓ to ⅘ of the total volume of the powder mixture.

11. The method as defined in claim 10, wherein during said mixing of said powders equal weights of said first powder and said second powder are mixed.

12. A material for friction components made by a process comprising the steps of:

a) providing a first powder consisting of grains of a comparatively harder material with a comparatively higher coefficient of friction, said grains of said first powder having an average grain size of from 60 to 100 microns, and a second powder consisting of grains of comparatively softer material with a comparatively lower coefficient of friction, said grains of said second powder having an average grain size of from 60 to 100 microns, wherein said comparatively softer material consists essentially of 1.5% Ni, 2% Cu, 0.5% Mo, 0.6 % C and with a remaining portion of the comparatively softer material consisting of iron;

b) mixing said first powder and said second powder to form a powder mixture having a total volume; and c) subjecting said powder mixture to a pressure and temperature sufficient for said grains of said first powder to be intermixed with said comparatively softer material of said second powder so that said comparatively softer material substantially fills an intergranular space between said grains of said first powder to form the material for the friction components, said comparatively harder material occupies from ⅓ to ⅘ of the total volume of the powder mixture.

13. The material for friction components as defined in claim 12, wherein said comparatively harder material consists essentially of 4% of Cr, 5% of Mo, 3% of V, 6% of W, 2% of Si, 0.6% of C and with a balance of iron.

* * * * *